US011019871B2

(12) United States Patent
Sadegh et al.

(10) Patent No.: US 11,019,871 B2
(45) Date of Patent: Jun. 1, 2021

(54) BIOMIMETIC AND INFLATABLE ENERGY-ABSORBING HELMET TO REDUCE HEAD INJURIES AND CONCUSSIONS

(71) Applicants: Ali M. Sadegh, Franklin Lakes, NJ (US); Peyman Honarmandi, Cresskill, NJ (US); Paul V. Cavallaro, Raynham, MA (US)

(72) Inventors: Ali M. Sadegh, Franklin Lakes, NJ (US); Peyman Honarmandi, Cresskill, NJ (US); Paul V. Cavallaro, Raynham, MA (US)

( * ) Notice: Subject to any disclaimer, the term of this patent is extended or adjusted under 35 U.S.C. 154(b) by 283 days.

(21) Appl. No.: 15/663,395

(22) Filed: Jul. 28, 2017

(65) Prior Publication Data

US 2019/0029352 A1 Jan. 31, 2019

(51) Int. Cl.
*A42B 3/06* (2006.01)
*A42B 3/12* (2006.01)

(52) U.S. Cl.
CPC ..... *A42B 3/06* (2013.01); *A42B 3/12* (2013.01); *A42B 3/121* (2013.01); *A42B 3/064* (2013.01)

(58) Field of Classification Search
CPC .. A42B 3/06; A42B 3/121; A42B 3/12; A42B 3/064; A42B 3/124
See application file for complete search history.

(56) References Cited

U.S. PATENT DOCUMENTS 3,600,714 A 8/1971 Cade et al.
3,849,801 A 11/1974 Holt et al.
3,999,220 A * 12/1976 Keltner ..... A42B 3/065 2/413
4,287,613 A 9/1981 Schulz
D267,287 S 12/1982 Gooding
4,566,137 A * 1/1986 Gooding ..... A42B 3/122 2/413
5,181,279 A * 1/1993 Ross ..... A42B 3/122 2/412
6,226,801 B1 5/2001 Alexander et al.
6,931,671 B2 8/2005 Skiba
7,341,776 B1 * 3/2008 Milliren ..... A41D 13/05 2/411
8,739,317 B2 * 6/2014 Abernethy ..... A42B 3/121 2/410
9,717,298 B1 * 8/2017 Barrett, Jr. ..... F16K 31/004
9,820,524 B1 * 11/2017 Whitcomb ..... F41H 1/04
(Continued)

*Primary Examiner* — Katharine G Kane
(74) *Attorney, Agent, or Firm* — Luccarelli & Musacchio LLP; Pasquale Musacchio

(57) ABSTRACT

A helmet for protecting the head of a user. The helmet includes an outer shell, an inner shell having padding that contacts the head and a cavity formed between the inner and the outer shells, wherein the cavity is filled with a fluid such as air. The helmet also includes a plurality of resilient strands located in the cavity and affixed between the outer and inner shells, wherein an impact force on the outer shell causes the head to impact the padding with a reaction force that compresses the cavity. Compression of the cavity pushes fluid through the strands to increase fluid friction and alter a velocity of the fluid. This decreases the energy of impact and consequently reduces an amount of force transferred to the head thereby protecting the head from normal and shear force.

7 Claims, 11 Drawing Sheets

(56) References Cited

U.S. PATENT DOCUMENTS

| | | | | |
|---|---|---|---|---|
| 9,925,440 | B2 * | 3/2018 | Davis | A43B 1/00 |
| 2006/0059606 | A1 | 3/2006 | Ferrara | |
| 2007/0226881 | A1 * | 10/2007 | Reinhard | A42B 3/322 2/412 |
| 2008/0066217 | A1 | 3/2008 | Depreitere et al. | |
| 2008/0251332 | A1 * | 10/2008 | Stuhmiller | A41D 13/0155 188/322.16 |
| 2008/0256686 | A1 | 10/2008 | Ferrara | |
| 2009/0288313 | A1 * | 11/2009 | Rapaport | B29C 66/83221 36/29 |
| 2012/0017358 | A1 * | 1/2012 | Princip | A42B 3/064 2/414 |
| 2012/0297526 | A1 * | 11/2012 | Leon | A42B 3/12 2/413 |
| 2014/0013492 | A1 * | 1/2014 | Bottlang | A42B 3/125 2/414 |
| 2014/0123371 | A1 | 5/2014 | Witcher | |
| 2015/0157081 | A1 | 6/2015 | Hyman | |
| 2016/0120255 | A1 | 5/2016 | Alexander | |
| 2016/0161222 | A1 * | 6/2016 | Lee | A42B 3/065 |
| 2016/0255900 | A1 * | 9/2016 | Browd | A42B 3/064 |
| 2016/0270471 | A1 * | 9/2016 | Merrell | A42B 3/121 |
| 2016/0278467 | A1 * | 9/2016 | Irwin | A42B 3/063 |
| 2016/0278470 | A1 * | 9/2016 | Posner | A42B 3/064 |
| 2016/0302496 | A1 * | 10/2016 | Ferrara | A42B 3/064 |
| 2017/0188648 | A1 * | 7/2017 | Larrabee | A42B 3/28 |
| 2017/0273387 | A1 * | 9/2017 | Sicking | A42B 3/064 |
| 2017/0295880 | A1 * | 10/2017 | Kennedy | A42B 3/064 |
| 2017/0303620 | A1 * | 10/2017 | Sicking | A42B 3/0473 |
| 2017/0303623 | A1 * | 10/2017 | Sicking | A42B 3/064 |

* cited by examiner

BIOMIMETIC AND INFLATABLE ENERGY-ABSORBING HELMET TO REDUCE HEAD INJURIES AND CONCUSSIONS

FIELD OF THE INVENTION

This invention relates to protective headgear for a user's head, and more particularly, to a helmet having a plurality of resilient strands located in a shock absorbing cavity filled with pressurized fluid wherein the strands are affixed between outer and inner shells of the helmet and wherein compression of the cavity due to a reaction force caused by the head pushes fluid through the strands to increase fluid friction and alter fluid velocity and thereby dissipate impact energy, and consequently reduce an amount of force transferred to the head.

BACKGROUND OF THE INVENTION

Protective headgear and helmets are used to minimize head injuries and in particular skull fractures. In contact sports, in particular American football, players are subjected to concussions which have recently become a subject of deep concern.

A concussion is neither a skull fracture nor a bruise to the brain, which is generally caused by hitting a hard surface. Rather, a concussion generally occurs when a person's head accelerates rapidly and then is stopped suddenly. Concussion symptoms often include headache, confusion, blurred vision, slurred speech, dizziness, amnesia, nausea, vomiting and unconsciousness. In addition, concussions increase the risk of neurodegenerative diseases such as Alzheimer's disease or other memory-related diseases.

Statistically, data from the National Football League (a professional American football league) shows that, on average, one concussion occurs in every other game and approximately 120 to 130 concussions occur during each regular season. Moreover, of the 160 players interviewed by the Associated Press news bureau, 50% reported experiencing at least one concussion and 38% acknowledged having missed playing time because of a concussion-related injury.

The human brain is protected by structures including the scalp, skull, meninges, and cerebral spinal fluid. The brain is anatomically suspended within the skull by arachnoid trabeculae and supported by a series of three fibrous tissue layers called dura mater, arachnoid mater and pia mater, known as the meninges. The meninges serve as a cushioning material that surrounds and protects the brain against impacts. Arachnoid trabeculae are strands of collagen tissues that are located in the space between the arachnoid and pia mater known as subarachnoid space (SAS). The SAS includes cerebrospinal fluid (CSF) which stabilizes the shape and the position of the brain during head movements. However, depending upon the magnitude of impact load, the natural protective mechanism/structure of the human body may not be effective against a high impact load due to relatively high changes in acceleration. Brain damage may result if the energy of impact cannot be sufficiently absorbed by the meninges/SAS/CSF structure or, in severe cases, contact between brain and skull may occur which leads to bleeding and neural-network damages.

A function of the CSF is to protect the brain and spinal cord from chemical and mechanical injuries. It has been also shown that the subarachnoid space (SAS) trabeculae play an important role in damping and reducing the relative movement of the brain with respect to the skull, thereby reducing traumatic brain injuries (TBI). The cerebrum is the largest part of the brain and consists of the gray and white matter each of which has important functions in muscle control and sensory perception. The cerebrum is the superior region of the central nervous system (CNS). The neural networks of the CNS facilitate complex behaviors such as social interactions, thought, judgment, learning, memory, and in humans, speech and language. The excessive stress and strain due to impact load will impair the neural networks of the CNS.

Previous attempts have been made to absorb the impact by adding more padding to the inside of the helmet or by changing the external shell of the helmets. However, many commercial helmets available in the market are not effective against concussion and may prevent player's head from only fracture. Therefore, it is desirable to improve helmet designs in order to reduce the likelihood of concussion-related injuries.

SUMMARY OF THE INVENTION

In an embodiment, a new design of helmet for protecting the user's head is disclosed. The helmet includes an outer shell, an inner shell having padding that contacts the head and a cavity formed between the inner and the outer shells, wherein the cavity is filled with a fluid. The helmet also includes a plurality of resilient strands located in the cavity and affixed between the outer and inner shells, wherein an impact force on the outer shell causes the head to impact the padding with a reaction force that compresses the cavity. Compression of the cavity pushes fluid through the strands to increase fluid friction and reduce overall velocity of the fluid and thereby an amount of force transferred to the head.

In a second embodiment, the helmet includes an outer shell having an inner surface that includes a first plurality of protrusions. The helmet also includes an inner shell having padding that contacts the head of a user wherein the inner shell further includes an outer surface having a second plurality of protrusions, wherein the first plurality of protrusions is not aligned with the second plurality of protrusions. First and second protrusions are staggered with any geometrical shape, e.g. bulge shape, wherein they mate each other during compression. In addition, a cavity is formed between the inner and outer surfaces. The helmet further includes a plurality of liner sections located between the first and second plurality of protrusions. A liner section is connected to an adjacent liner section by a connector element that enables fluid communication between the liner sections wherein the liner sections are filled with a fluid. An impact force on the outer shell causes the head to impact the padding with a reaction force that compresses the cavity. Compression of the cavity compresses at least one liner and pushes fluid from the liner and subsequently through at least one connector element to increase fluid friction and reduce a velocity of the fluid and thereby an amount of force transferred to the head.

In a third embodiment, the helmet includes an outer shell having an inner surface and an inner shell having paddings that contact the head of a user, wherein the inner shell further includes an outer surface. The helmet also includes a cavity formed between the inner and outer surfaces and a plurality of shock absorbing elements located between the inner and outer surfaces. Each shock absorbing element includes upper and lower walls that confines an internal chamber having a plurality of strands affixed between the upper and lower walls. A shock absorbing element is connected to an adjacent shock absorbing element by a connector element that enables fluid communication between the shock absorbing elements wherein the shock absorbing elements are filled with a fluid. An impact force on the outer shell causes the head to impact the padding with a reaction force that compresses the cavity. Compression of the cavity compresses at least one shock absorbing element and pushes fluid through the strands of the shock absorbing element and at least one connector element to increase fluid friction and reduce a velocity of the fluid and thereby an amount of force transferred to the head. Each strand serves as a baffle contributing to the damping of impact energy.

Those skilled in the art may apply the respective features of the present invention jointly or severally in any combination or sub-combination.

BRIEF DESCRIPTION OF THE DRAWINGS

The exemplary embodiments of the invention are further described in the following detailed description in conjunction with the accompanying drawings, in which.

To facilitate understanding, identical reference numerals have been used, where possible, to designate identical elements that are common to the figures. The figures are not drawn to scale.

DETAILED DESCRIPTION OF THE INVENTION

Figure 1:
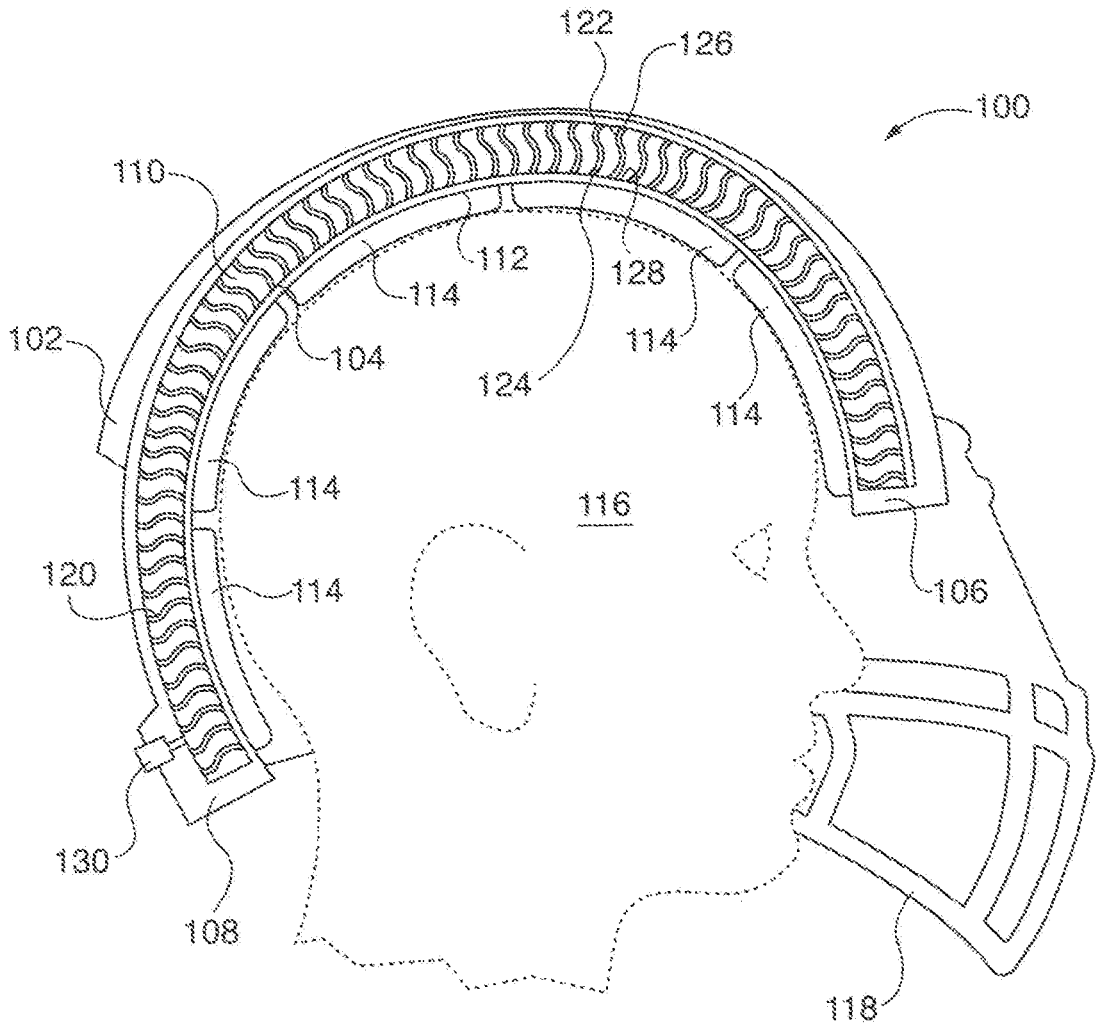
FIG. 1 is a sagittal cross-sectional view of a helmet in accordance with a first embodiment of the invention.

Although various embodiments that incorporate the teachings of the present disclosure have been shown and described in detail herein, those skilled in the art can readily devise many other varied embodiments that still incorporate these teachings. The scope of the disclosure is not limited in its application to the exemplary embodiment details of construction and the arrangement of components set forth in the description or illustrated in the drawings. The disclosure encompasses other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 2:
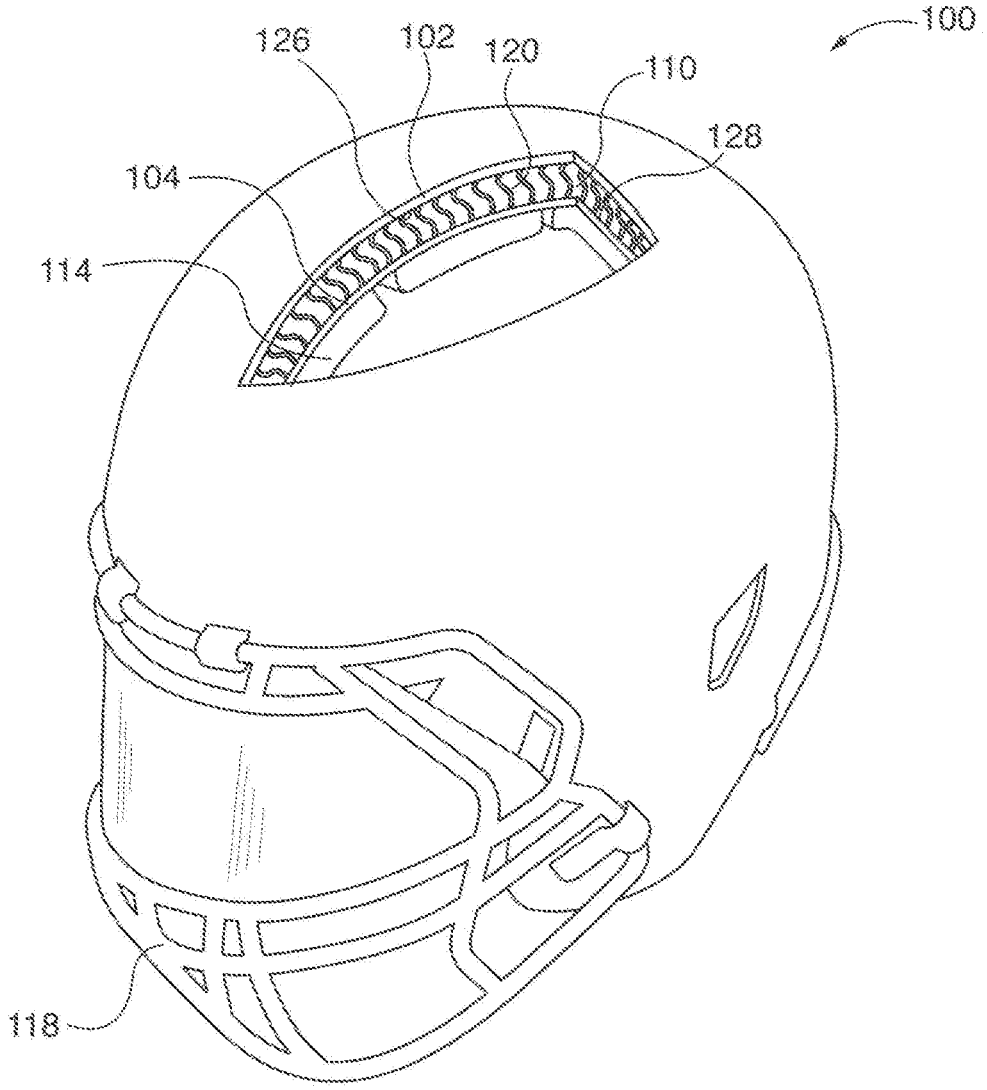
FIG. 2 depicts a perspective view of the first embodiment and illustrates a coronal cross-section of the helmet.

FIG. 1 is a sagittal cross-sectional view of a helmet 100 in accordance with a first embodiment of the invention. FIG. 2 depicts a perspective view of the first embodiment and illustrates a coronal cross-section of the helmet 100. Referring to FIG. 1 in conjunction with FIG. 2, the helmet 100 includes spaced-apart outer 102 and inner 104 shells connected by front 106 and rear 108 end walls to form a shock absorbing cavity 110. An inner surface 112 of the inner shell 104 includes padding elements 114 that contact the head 116 of a person or user. The padding elements 114 are fabricated from a material suitable for providing comfort to the user such as a known soft sponge-like material. The outer shell 102 may be fabricated from a hard material such as a thermoplastic polymer while the inner shell 104 may be fabricated from a known soft and deformable material. It is understood that the helmet 100 may include additional padding elements and/or pads that include shock absorbing gel material. The helmet 100 may also include a facemask 118 to protect a user's face.

The cavity 110 includes a plurality of resilient thin rods or strands 120. In an embodiment, the strands 120 are fabricated from a viscoelastic or soft elastic material and may be substantially curved and/or S-shaped. Configuring each strand 120 into a curved or S-shape, rather than as a straight strand, provides an additional length of strand material that serves to increase fluid friction and provides eccentricity to allow buckling of the strands 120 when the helmet 142 is subjected to a compressive impact as will be described. It is understood that other materials and shapes may be used for the strands 120. First 122 and second 124 ends of each strand 120 are affixed to inner 126 and outer 128 surfaces of the outer 102 and inner 104 shells, respectively. The strands 120 are spaced-apart relative to each other and may be arranged in a random configuration to form a dense arrangement or network of strands 120 that in turn form a plurality of air passages. Alternatively, the strands 120 may be arranged in either staggered, asymmetrical, serpentine or other configurations and/or combinations thereof. For purposes of clarity, a single row of strands 120 is shown in FIG. 1. The cavity 110 also includes a suitable fluid such as air, oil or a jell. In an embodiment, the fluid may be either pressurized or non-pressurized. The cavity 110 is filled via a valve 130 that extends through the helmet 100 and is in fluid communication with the cavity 110.

Figure 3:
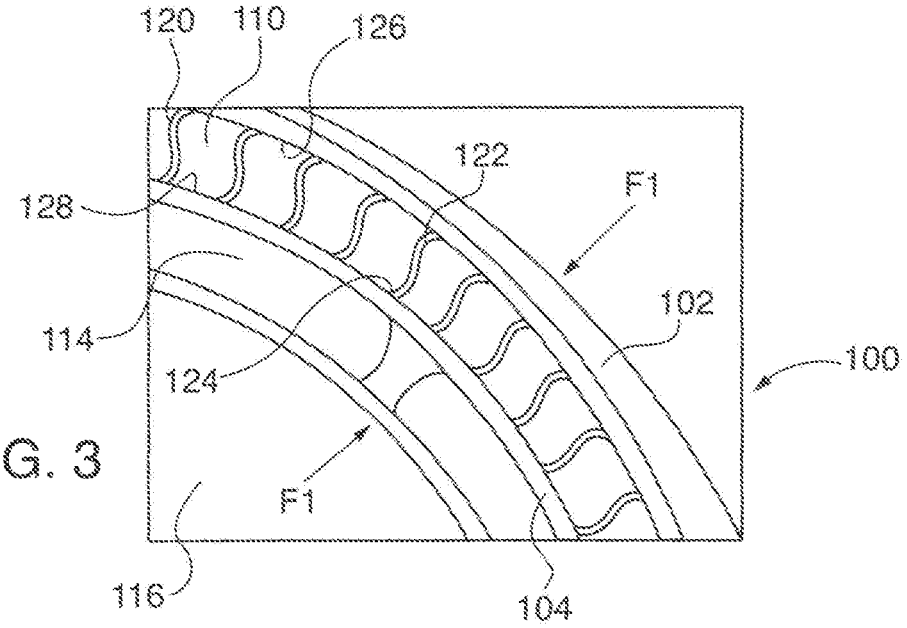
FIG. 3 is an expanded cross-sectional view of a portion of the helmet when subjected to a normal impact force F1.

FIG. 3 is an expanded cross-sectional view of a portion of the helmet 100. When the helmet 100 is subjected to a substantially normal impact force F1, the head 116 moves towards the point of loading and impacts the padding elements 114 with an equal reaction force F1 directionally opposite impact force F1. This results in local compression of the cavity 110 and causes nearby strands 120 to deflect and buckle to absorb a portion of the reaction force F1. Due to the compression, the fluid is also pushed away at a first velocity from the point of loading and toward adjacent strands 120. As fluid passes around the adjacent strands 120, friction between the fluid and the adjacent strands 120 causes a reduction in the velocity of the fluid, thus causing damping and resulting in fluid-solid interactions. By reducing the velocity of the fluid, the amount of force transferred to the head is reduced which ultimately reduces the risk of concussion injuries.

Figure 4:
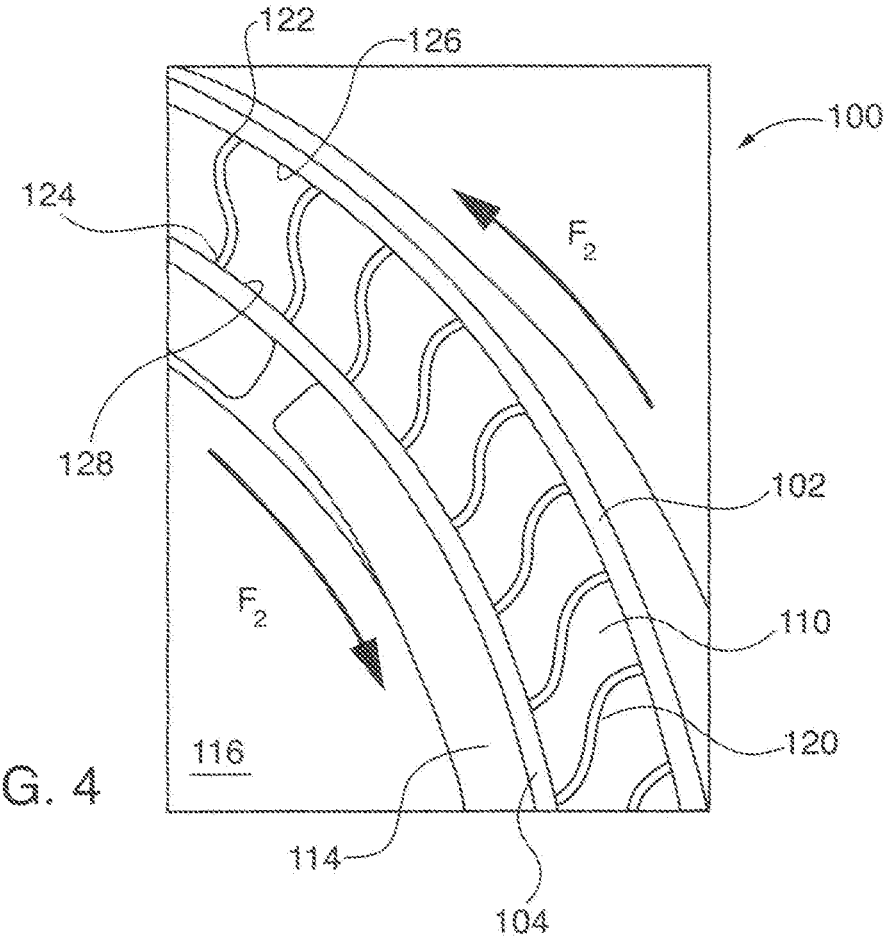
FIG. 4 is a cross-sectional view of a portion of the helmet being subjected to a shearing impact load F2.

In FIG. 4, the helmet 100 is shown being subjected to a shearing impact load F2. When this occurs, the head 116 moves towards the point of loading and impacts the padding elements 114 with an equal reaction force F2 directionally opposite impact force F2. This also results in local compression of the cavity 110 and causes local stretching of the strands 120 to absorb a portion of the reaction force F2. Due to the compression, air is also pushed away at a first velocity from the point of loading and toward adjacent strands 120. As air passes around the adjacent strands 120, friction between the air and the adjacent strands 120 causes a reduction in the velocity of the air, thus damping the air as previously described to reduce the amount of force transferred to the head.

The strands 120 located in the cavity 110 and connected between the inner 126 and outer 128 surfaces correspond to the trabeculae that connect the arachnoid and pia mater of the human brain. The fluid, such as air, within the outer 102 and inner 104 shells corresponds to the cerebral spinal fluid (CSF). Thus, the invention provides a substantially biomimetic platform or structure that mimics or imitates the brain subarachnoid space in humans wherein the CSF and the trabeculae act as dampers to brain motion.

Figure 5:
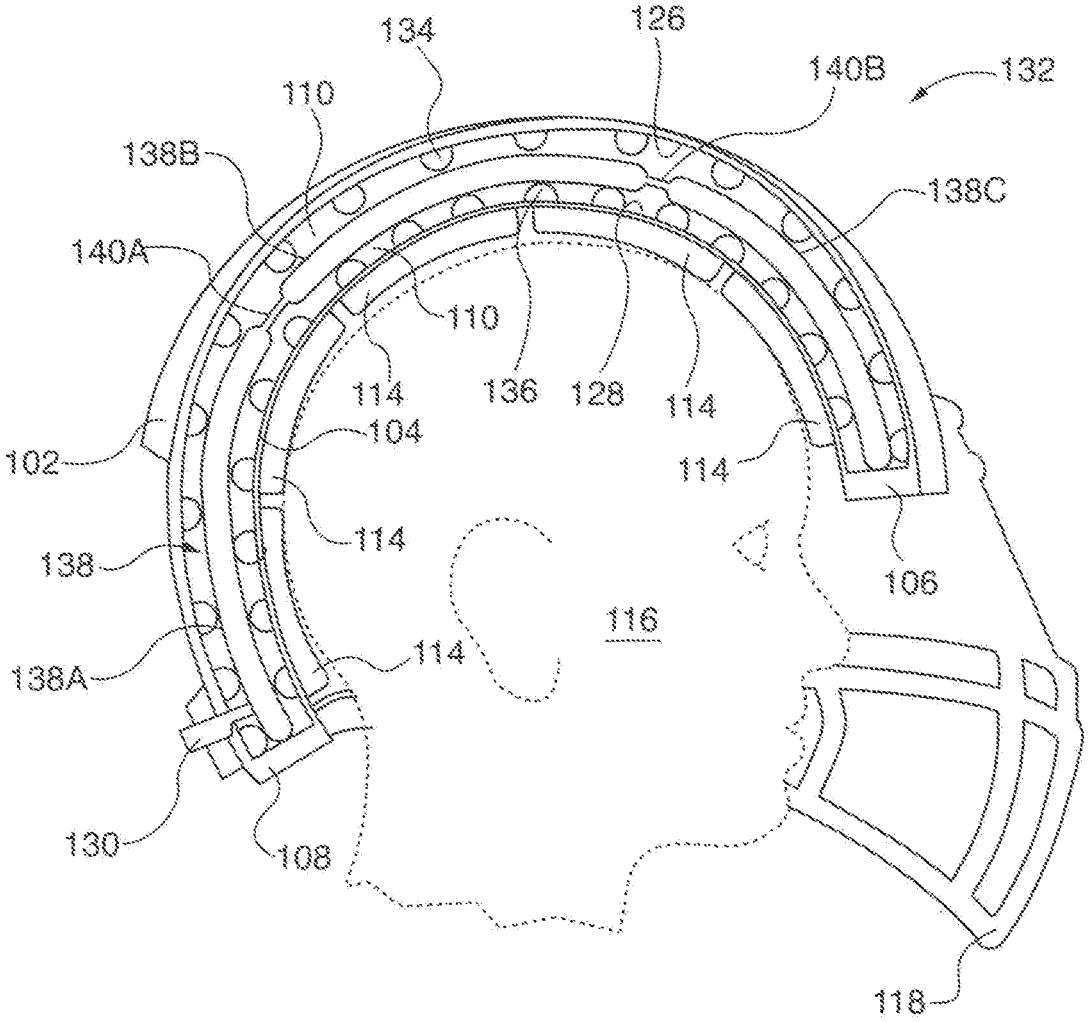
FIG. 5 depicts a sagittal cross-sectional view of a helmet in accordance with a second embodiment of the invention.
Figure 6:
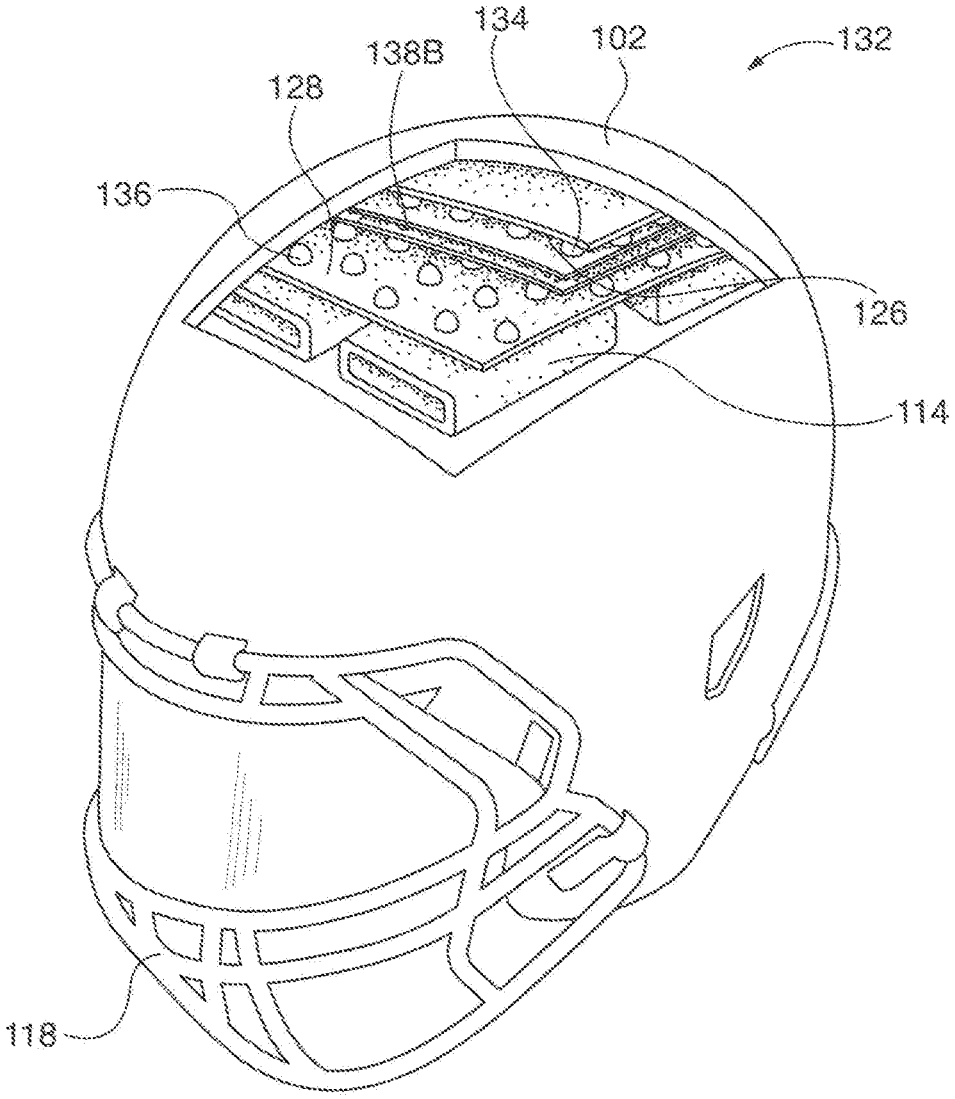
FIG. 6 depicts a perspective view of the second embodiment and illustrates a coronal cross-section of the helmet.

FIG. 5 depicts a sagittal cross-sectional view of a helmet 132 in accordance with a second embodiment of the invention. FIG. 6 depicts a perspective view of the second embodiment and illustrates a coronal cross-section of the helmet 200. Referring to FIG. 5 in conjunction with FIG. 6, the inner 126 and outer 128 surfaces of the outer 102 and inner 104 shells include a plurality of upper 134 and lower 136 bulges or protrusions, respectively. The upper 134 and lower 136 protrusions extend within the cavity 110. Further, the upper protrusions 134 are not aligned with the lower protrusions 136 to form a staggered arrangement. In an embodiment, the upper 134 and lower 136 protrusions are semi-spherically shaped although it is understood that other shapes may be used. An inflatable liner 138 is located in the cavity 110 between the upper 134 and lower 136 protrusions. The liner 138 includes a plurality of liner sections wherein a first liner section is connected to an adjacent liner section by a connector element that provides fluid communication between the liner sections. The connector element may be a tube having an interior channel that extends through the connector element to provide fluid communication between adjacent liner sections. The interior channel may have a constant or variable inner diameter along its length to reduce the flow of fluid from one liner section to an adjacent liner section. In an embodiment, the liner 138 includes first 138A, second 138B and third 138C liner sections. The first 138A and second 138B liner sections are connected by a first connector 140A and the second 138B and third 138C liner sections are connected by a second connector 140B. The first connector 140A enables fluid communication between the first 138A and second 138B liner sections and the second connector 140B enables fluid communication between the second 138B and third 138C liner sections to ultimately enable fluid communication between the first 138A, second 138B and third 138C liner sections. The first 138A, second 138B and third 138C liner sections are filled with a fluid such as air via a valve 130 that extends through the helmet 132 and is in fluid communication with the first liner section 138A. Alternatively, at least one liner section 138A, 138B, 138C may include a valve 130. It is understood that although three liners depicted in FIG. 5, the number of liners 138 may vary depend upon the size and dimension of helmet.

Figure 7:
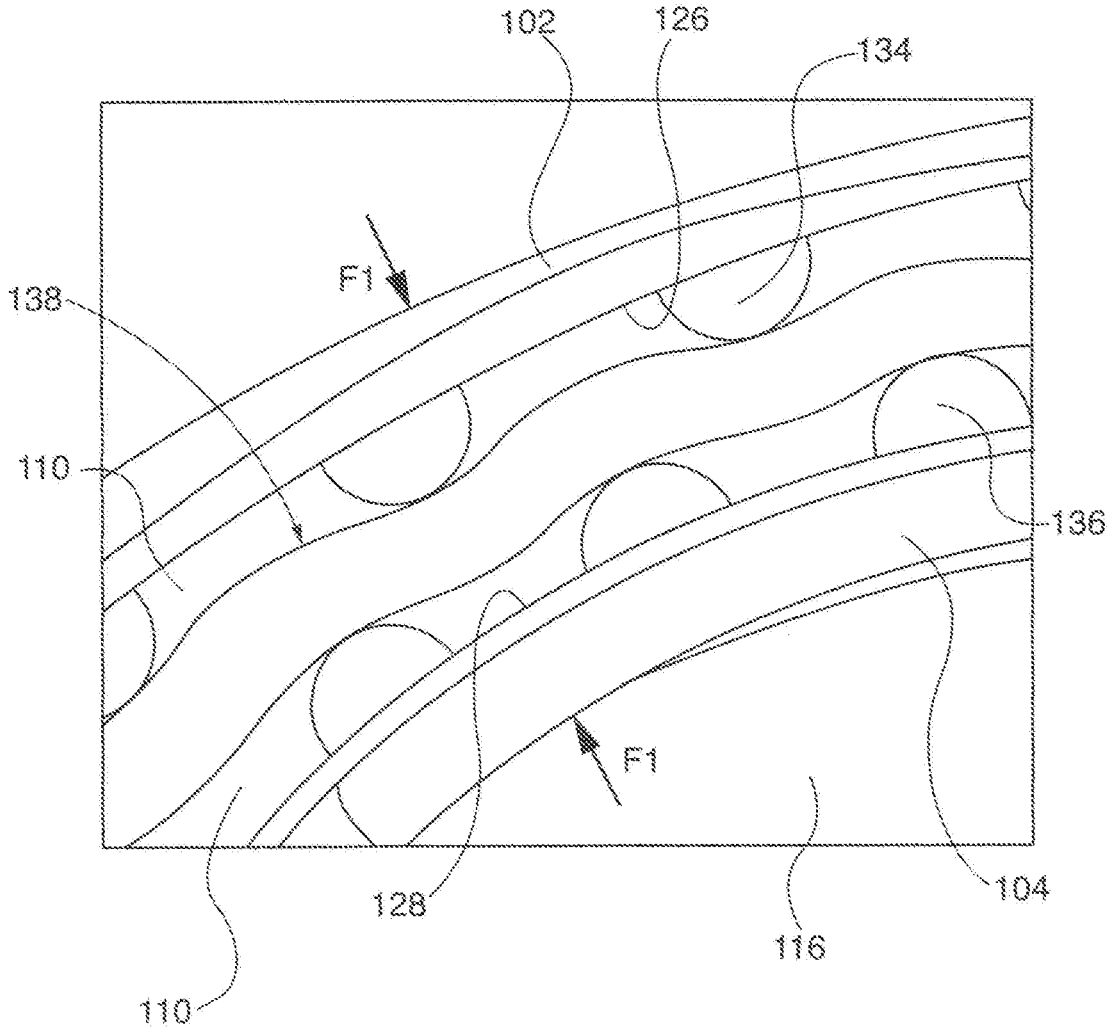
FIG. 7 is an expanded cross-sectional view of a portion of the helmet of the second embodiment when subjected to a normal impact force F1.

FIG. 7 is an expanded cross-sectional view of a portion of the helmet 132. When the helmet 132 is subjected to a substantially normal impact force F1, the head 116 moves towards the point of loading and locally compresses the cavity 110 as previously described. This causes compression of a liner section 138A, 138B, 138C. For purposes of illustration, the invention will be described with reference to second liner section 138B once liner 138 is compressed. Due to the compression, fluid such as jell or air is pushed away at a first velocity from the point of loading and through the first 140A and second 140B to the other liner sections 138A and 138C. The connectors 140A and 140B are sized so as to restrict air flow between liner sections 138A, 138B and 138C. Fluid friction due to movement of the fluid through the liner sections 138A, 138B and 138C and connectors 140A and 140B reduces velocity of the fluid, thus damping the impact energy and reducing the amount of force transferred to the head 116.

Figure 8:
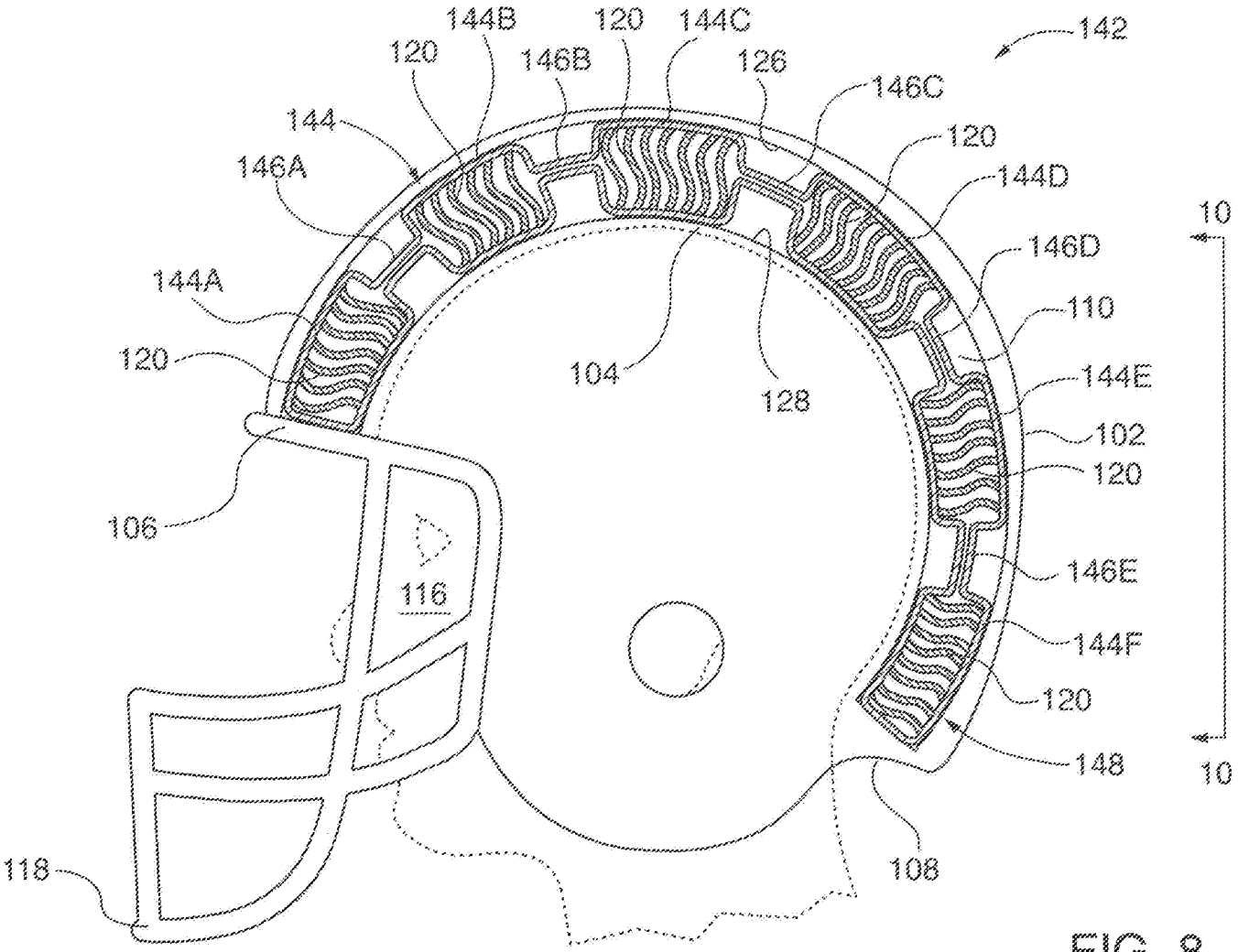
FIG. 8 depicts a sagittal cross-sectional view of a helmet in accordance with a third embodiment of the invention.

FIG. 8 depicts a sagittal cross-sectional view of a helmet 142 in accordance with a third embodiment of the invention. In this embodiment, the cavity 110 includes a plurality of shock absorbing elements 144 located within the cavity. For example, the helmet 142 may include first 144A, second 144B, third 144C, fourth 144D, fifth 144E and sixth 144F shock absorbing elements. A shock absorbing element 144 is connected to an adjacent shock absorbing element 144 by a connector element that provides fluid communication between the shock absorbing elements 144. For example, the connector element may be a tube. The first 144A and second 144B shock absorbing elements are connected by a first connector 146A, the second 144B and third 144C shock absorbing elements are connected by a second connector 146B, the third 144C and fourth 144D shock absorbing elements are connected by a third connector 146C, the fourth 144D and fifth 144E shock absorbing elements are connected by a fourth connector 146D and the fifth 144E and sixth 144F shock absorbing elements are connected by a fifth connector 146E. The first connector 146A enables fluid communication between the first 144A and second 144B shock absorbing elements, the second connector 146B enables fluid communication between the second 144B and third 144C shock absorbing elements, the third connector 146C enables fluid communication between the third 144C and fourth 144D shock absorbing elements, the fourth connector 146D enables fluid communication between the fourth 144D and fifth 144E shock absorbing elements and the fifth connector 146E enables fluid communication between the fifth 144E and sixth 144F shock absorbing elements to ultimately enable fluid communication between the first 144A, second 144B, third 144C, fourth 144D, fifth 144E and sixth 144F shock absorbing elements to form a liner arrangement 148. It is understood that although six elements depicted in FIG. 8, the number of shock absorbing elements 144 may vary depend upon the size and dimension of helmet. The fluid can also be air, other gases or liquids. The shock absorbing elements 144A, 144B, 144C, 144D, 144E, 144F are filled with pressurized or low to non-pressurized fluid such as air provided via a valve. The level of pressure depends upon the user's weight. The connectors 146A, 146B, 146C, 146D, 146E, 144F are sized to restrict fluid flow between associated shock absorbing elements 144A, 144B, 144C, 144D, 144E, 144F. Fluid friction due to movement of fluid through the shock absorbing elements 144A, 144B, 144C, 144D, 144E, 144F and connectors 146A, 146B, 146C, 146D, 146E, 144F reduces velocity of the fluid, thus damping the energy of impact and ultimately reducing the amount of force transferred to the head 116.

Figure 9:
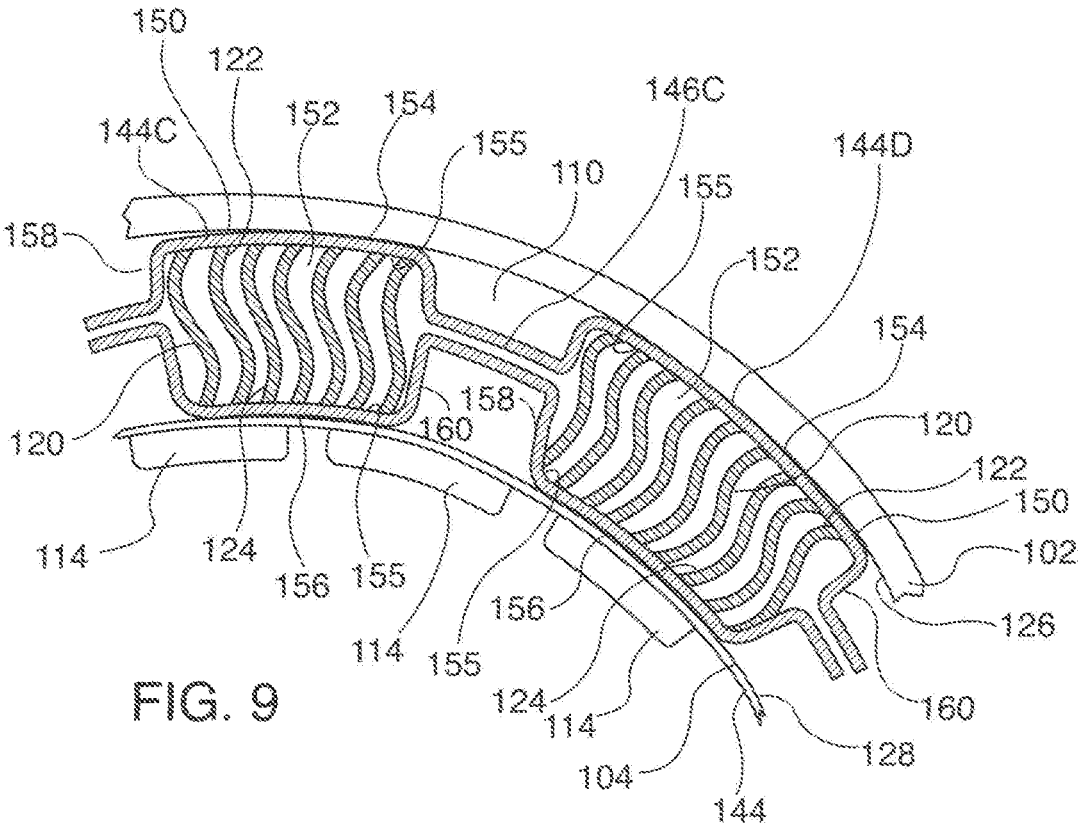
FIG. 9 is an expanded cross-sectional view of exemplary shock absorbing elements.

FIG. 9 is an expanded cross-sectional view of exemplary shock absorbing elements wherein the third 144C and fourth 144D shock absorbing elements are depicted for purposes of illustration. Each shock absorbing element 144A, 144B, 144C, 144D, 144E, 144F includes a flexible housing 150 having an internal chamber 152 defined by upper 154 and lower 156 walls and first 158 and second 160 end walls. Each chamber 152 includes a plurality of strands 120 as previously described. First 122 and second 124 ends of each strand 120 are affixed to an inner surface 155 of the upper 154 and lower 156 walls, respectively. As previously described, the strands 120 are spaced-apart relative to each other and may be arranged in a random configuration to form a dense arrangement or network of strands 120 that in turn form a plurality of fluid passages. Alternatively, the strands 120 may be arranged in either staggered, asymmetrical, serpentine or other configurations and/or combinations thereof. The first 158 and second 160 end walls each include a connector for connecting to an adjacent shock absorbing element.

Local compression of the cavity 110 causes a corresponding compression of at least one shock absorbing element 144A, 144B, 144C, 144D, 144E, 144F. This pushes away fluid in the compressed shock absorbing element at a first velocity from a point of loading and toward adjacent strands 120 as previously described. As fluid such as air passes around the adjacent strands, friction between the air and the adjacent strands 120 causes a reduction in the velocity of the air, thus also damping the air prior to the air being transferred to an adjacent shock absorbing element. Reducing the velocity of the air reduces the amount of force transferred to the head 116 and ultimately reduces the risk of concussion injuries.

Figure 10:
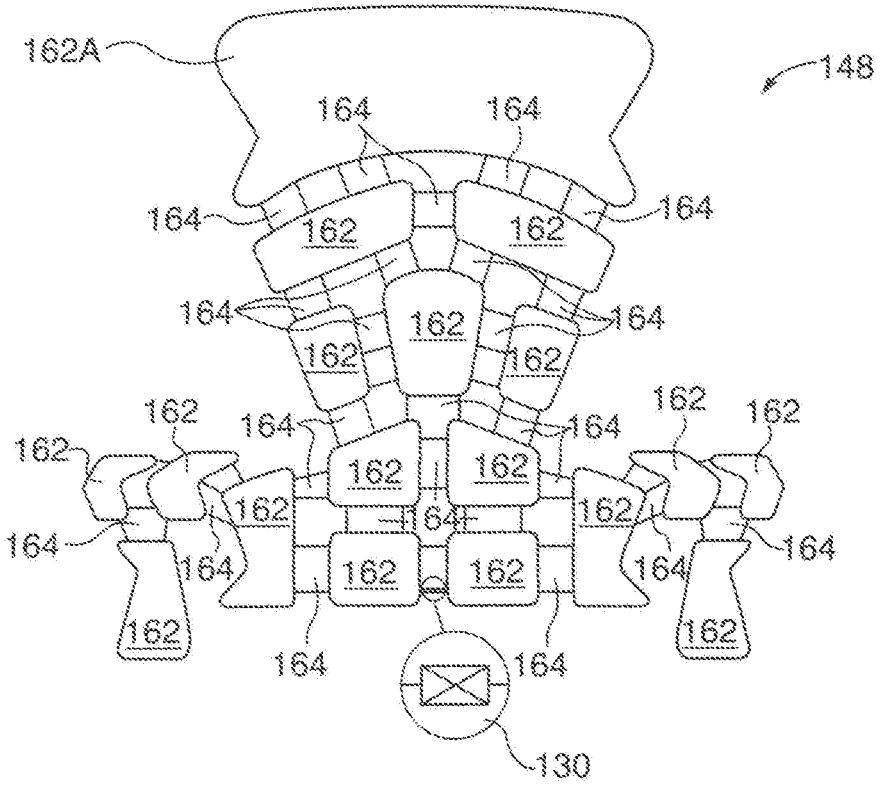
FIG. 10 depicts an exemplary liner and associated air valve along view line 10-10 of FIG. 8 wherein the liner is shown without the helmet and unfolded.

FIG. 10 is a view of an exemplary liner 148 and associated air/fluid valves 130 within connectors 164 along view line 10-10 of FIG. 8 wherein the liner is shown without the helmet and unfolded. The liner 148 includes a plurality of shock absorbing elements 162 which may be configured as either of the 144A, 144B, 144C, 144D, 144E, 144F shock absorbing elements. The size, shape and orientation of each shock absorbing element 162 may be configured to provide optimal protection for the portion of the head 116 that is to be protected. For example, the liner 148 may include a shock absorbing element 162A that is larger than the remaining shock absorbing elements 162 in order to protect the front of a user's head 116. As previously described, each shock absorbing element 162, 162A is in fluid communication with an adjacent shock absorbing element via connectors 164 which serve as dampers. In an embodiment, the connectors 164 are tubes as previously described. This forms a network of shock absorbing elements 162, 162A and connectors 164, which, in combination with the strands 120 in each shock absorbing element 162, 162A and pressurized or non-pressurized fluid, reduces the amount of force transferred to the head 116 and ultimately reduces the risk of concussion injuries. As previously described, the shock absorbing elements 162, 162A and connectors 164 are located in the cavity 110 formed in the helmet 142. Further, the number and size of the shock absorbing elements 162, 162A may also depend on the size of the helmet 142.

Figure 11:
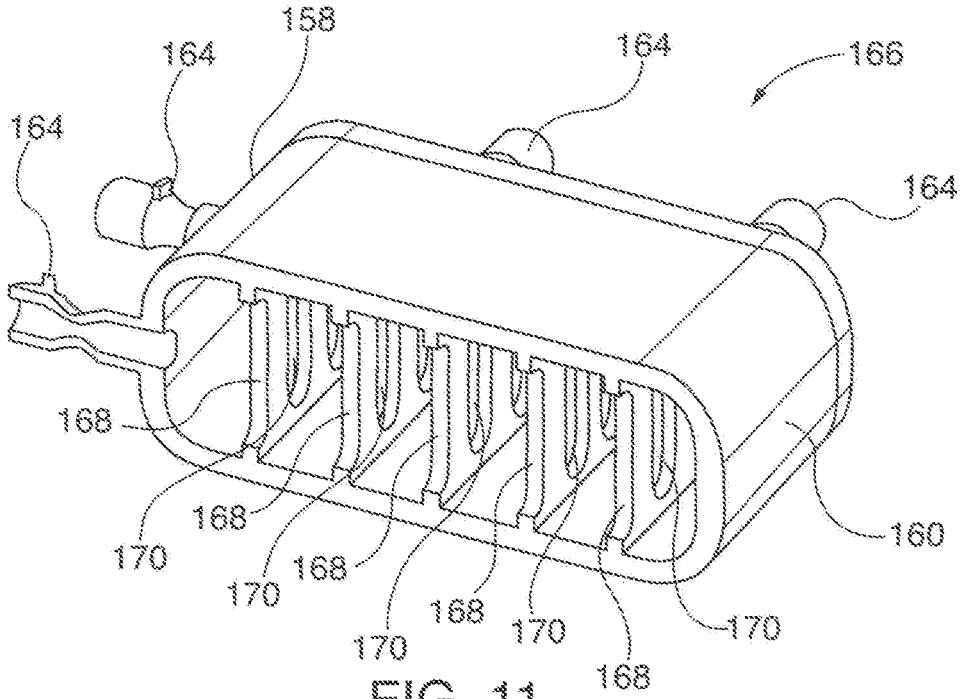
FIG. 11 is an isometric sectional view of an alternate embodiment for a shock absorbing element.
Figure 12:
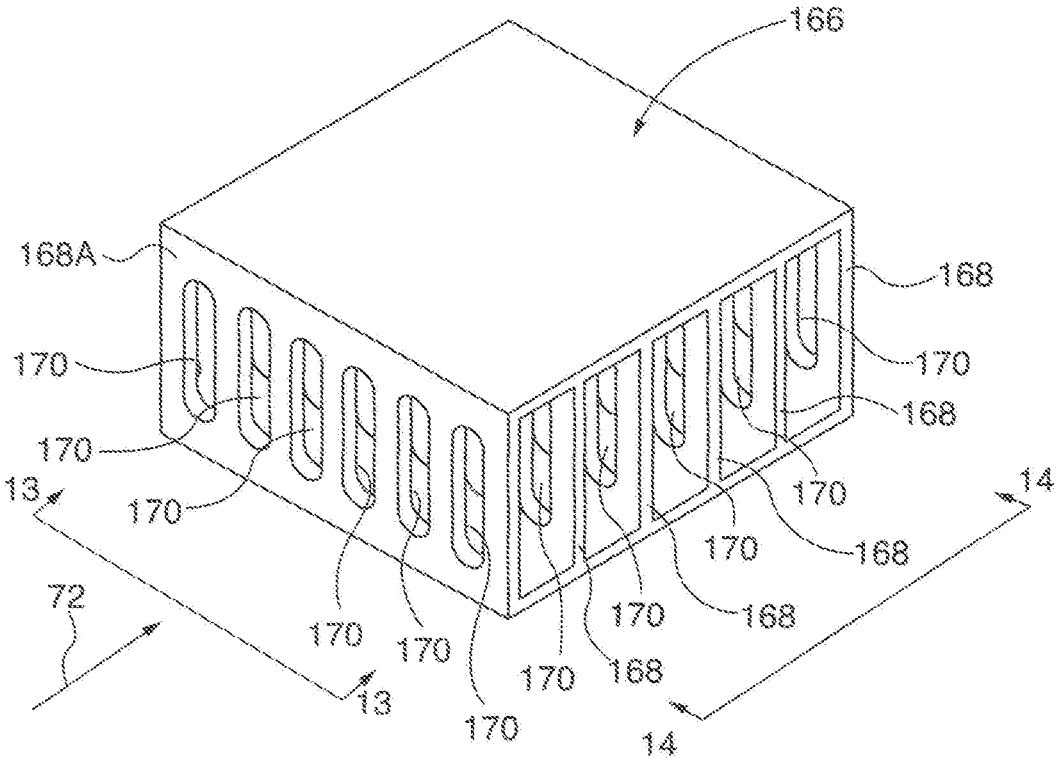
FIG. 12 illustrates an isometric view of internal strands of the shock absorbing element of the alternate embodiment without surrounding walls.
Figure 13A:
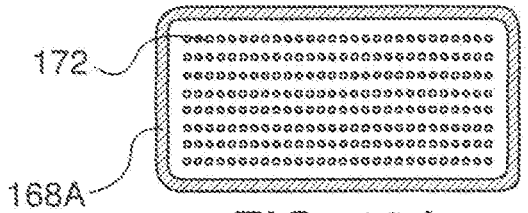
FIGS. 13A-13K depict alternate embodiments and arrangements for the holes of the strands inside the shock absorbing element along view line 13-13 of FIG. 12.
Figure 13B:
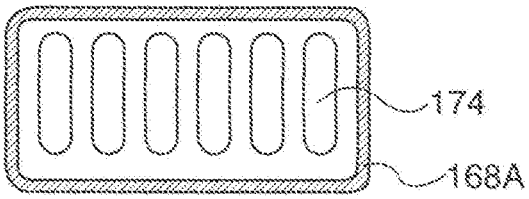
Figure 13C:
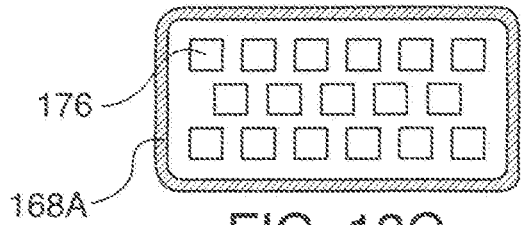
Figure 13D:
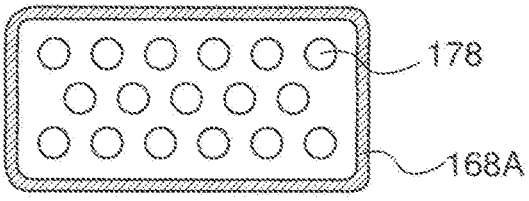
Figure 13E:
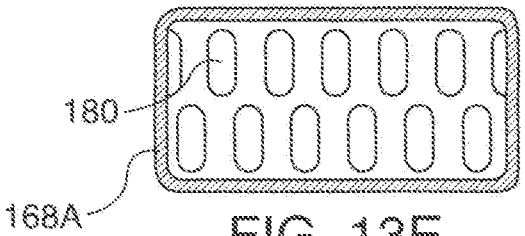
Figure 13F:
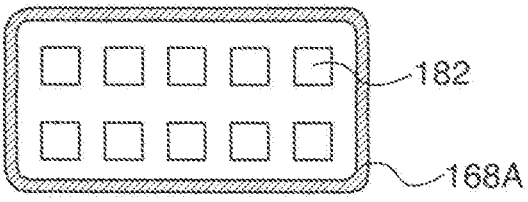
Figure 13G:
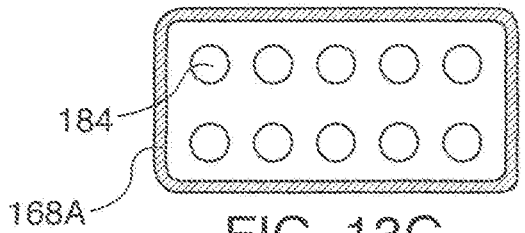
Figure 13H:
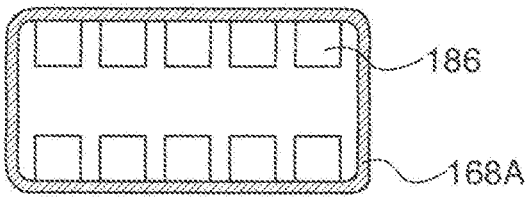
Figure 13I:
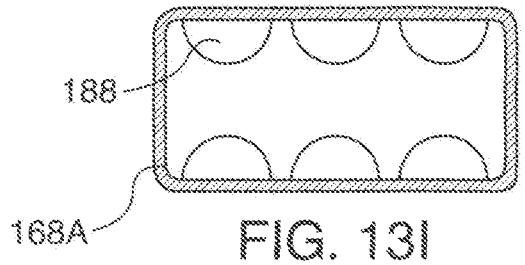
Figure 13J:
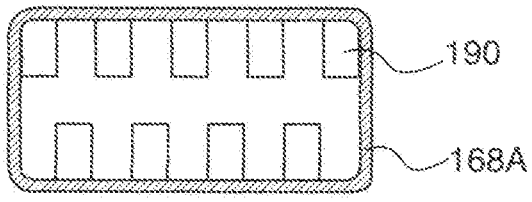
Figure 13K:
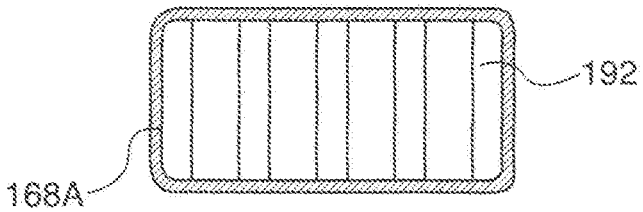

Referring to FIG. 11, an isometric sectional view of an alternate embodiment for a shock absorbing element 166 is shown. In this embodiment, the strands 120 are replaced by substantially vertical walls 168 each including a plurality of holes 170 that enable fluid passage and create fluid friction. FIG. 12 illustrates an isometric view of internal strands of the shock absorbing element 166 without surrounding walls. Fluid flows in a first direction 172 toward a first wall 168A of the shock absorbing element 166 and through the holes 170, and then to subsequent walls 168 and associated holes 170, to create air friction. In an embodiment, the holes 170 may have an elongated or oval shape. In accordance with the invention, the holes 170 may have a variety of shapes with different configurations and arrangements as exemplified in FIGS. 13A-13K. In particular, first wall 168A and subsequent walls 168 may include holes 170 arranged in the following shapes and configurations: holes 170 arranged in a mesh pattern 172 (FIG. 13A), holes 174 configured as substantially vertical ellipses (FIG. 13B), non-aligned or skewed square shaped holes 176 (FIG. 13C), skewed circular holes 178 (FIG. 13D), skewed elliptical holes 180 (FIG. 13E), symmetrically arranged or organized square shaped holes 182 (FIG. 13F), organized circular holes 184 (FIG. 13G), spaced-apart or offset square holes 186 (FIG. 13H), offset holes 188 shaped as half-circles (FIG. 13I), skewed rectangular holes 190 (FIG. 13J) and elongated rectangular holes 192 (FIG. 13K).

Figure 14A:
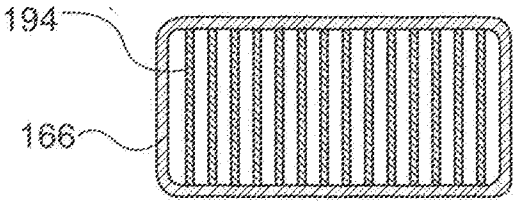
FIGS. 14A-14J show side views of alternate shapes for the strands of the shock absorbing element along view line 14-14 of FIG. 12.
Figure 14D:
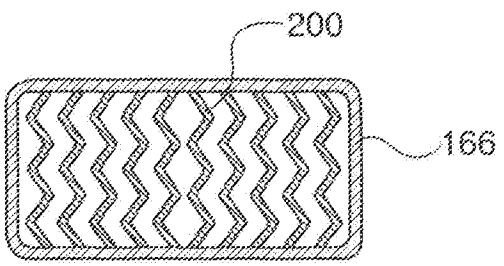
Figure 14B:
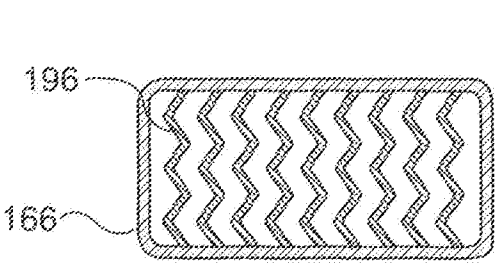
Figure 14C:
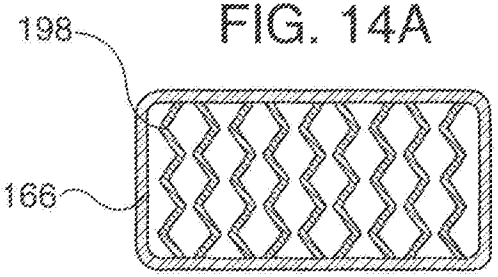
Figure 14G:
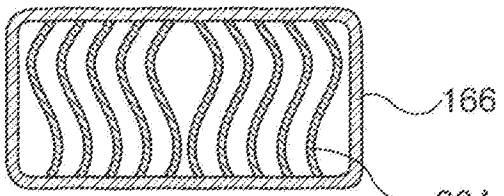
Figure 14F:
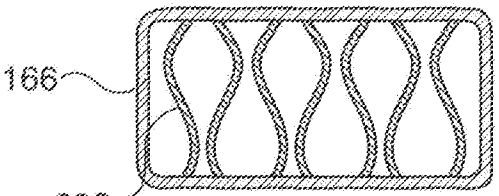
Figure 14E:
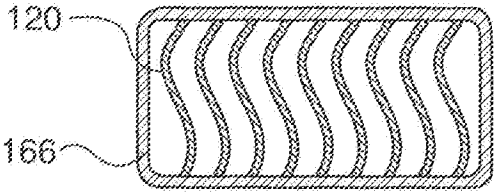
Figure 14J:
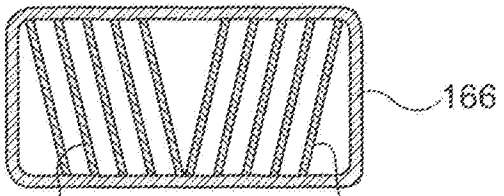
Figure 14I:
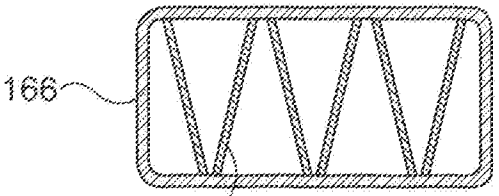
Figure 14H:
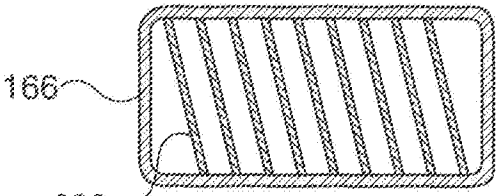

FIGS. 14A-14J show side views of alternate shapes for the strands 120 along view line 14-14 of FIG. 12. As previously described, the strands 120 may be substantially S-shaped as shown in FIG. 14E. As previously described, configuring each strand 120 into an S-shape, rather than as a straight strand, provides an additional length of strand material that serves to increase fluid friction and provides eccentricity to allow buckling of the strands 120 when the helmet 142 is subjected to a compressive impact. It is understood that other shapes and configurations may be used for the strands such as strands 194 that are arranged as vertical strips (FIG. 14A), vertical triangle shaped strands 196 (FIG. 14B), opposed vertical triangle shaped strands 198 (FIG. 14C), asymmetrical opposed vertical triangle shaped strands 200 (FIG. 14D), strands 202 arranged to form keyhole shapes (FIG. 14F), opposed S-shaped strands 204 (FIG. 14G), diagonally oriented strands 206 (FIG. 14H), strands 208 arranged in substantial V-shapes (FIG. 14I) and first diagonal strands 210 oriented in a first direction and second diagonal strands 212 oriented in a second direction opposite the first direction.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A helmet for protecting the head of a user, comprising:

an outer shell;

an inner shell having padding that contacts the head;

an enclosed fluid cavity having a volume formed between the inner and the outer shells, wherein the cavity is filled with a pressurized fluid and wherein a size of the cavity between the inner and outer shells is constant to form a flow channel for the pressurized fluid prior to an impact force acting on the outer shell wherein the impact force on the outer shell at an impact location causes the volume to deform; and a plurality of resilient curvilinear strands having a curvilinear shape, wherein the strands are located in the cavity and affixed between the outer and inner shells, and wherein the strands remain curvilinear after the cavity is filled with pressurized fluid and wherein the impact force causes the head to impact the padding producing a reaction force that causes local compression of the cavity due to a normal impact and relative rotation of the outer and inner shells due to a shearing impact, wherein local compression of the cavity during normal impacts absorbs a portion of the normal impact force through (a) work done on the fluid by instantaneously increasing the fluid pressure above an initial pressurized state wherein upon removal of the impact force the pressure and volume of the cavity return to their initial states, (b) strain energy produced in the strands that causes a redistribution of strand nonlinear tension forces generated by straightening of the strands followed by elastic stretching of the strands wherein strands located at the impact location are subject to superposition of compressive impact forces opposite in sense to the strand pretension forces developed due to the initial pressurization of the cavity to cause a net reduction in strand tension forces and wherein strands remote from the impact location initially straighten and then stretch and cause superposition of tension forces from impact with their pretensions due to the initial pressurization of the cavity to cause a net increase in strand tension forces, (c) straightening of the strands followed by elastic stretching of the strands to provide a nonlinear stiffness behavior of the strands during normal or shearing impacts caused by relative rotations of the outer and inner shells that result in net increases in strand tension forces, (d) fluid friction generated by the flow of the fluid pushing through the strands reducing the velocity of the fluid and the amount of force transferred to the head, (e) wherein during an impact event the curvilinearity of the strands unravels from the curvilinear shape to a substantially straight shape to enable additional displacement between the outer and inner shells prior to tension being formed in the strands to reduce the impact force and acceleration transferred to the head, and (f) wherein unraveling of the curvilinearity of the strands increases an exposed length of the strands to correspondingly increase fluid friction generated by the flow of fluid pushing through the strands to increase a damping effectiveness of the helmet.

2. The helmet according to claim 1, wherein the curvilinear strands are arranged in a random or structured pattern.

3. The helmet according to claim 1, wherein the curvilinear strands are fabricated from a material having viscoelastic properties with tension-compression or tension-only characteristics.

4. The helmet according to claim 1, wherein the curvilinear strands deflect due to a normal impact force wherein deflection of the strands absorbs a portion of the reaction force.

5. The helmet according to claim 1, wherein the curvilinear strands stretch due to an increase in fluid pressure and/or from a shearing impact force due to the relative rotations of the outer and inner shells wherein stretching of the strands absorbs a portion of the reaction force.

6. The helmet according to claim 1, wherein the pressurized fluid is air, oil or a jell.

7. The helmet according to claim 1, wherein the strands are substantially S-shaped having nonlinear force displacement characteristics between the outer and inner shells through initial straightening followed by stretching to reduce the impact force and acceleration to the head.

* * * * *